US011415130B2

(12) United States Patent
Fujita et al.

(10) Patent No.: US 11,415,130 B2
(45) Date of Patent: Aug. 16, 2022

(54) SCROLL COMPRESSOR

(71) Applicant: MITSUBISHI HEAVY INDUSTRIES THERMAL SYSTEMS, LTD., Tokyo (JP)

(72) Inventors: Katsuhiro Fujita, Tokyo (JP); Takayuki Kuwahara, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 13 days.

(21) Appl. No.: 16/759,129

(22) PCT Filed: Nov. 26, 2018

(86) PCT No.: PCT/JP2018/043372
§ 371 (c)(1),
(2) Date: Apr. 24, 2020

(87) PCT Pub. No.: WO2019/107306
PCT Pub. Date: Jun. 6, 2019

(65) Prior Publication Data

US 2021/0180594 A1 Jun. 17, 2021

(30) Foreign Application Priority Data

Nov. 29, 2017 (JP) ..... JP2017-229348

(51) Int. Cl.
*F04C 18/02* (2006.01)
*F04C 29/02* (2006.01)

(52) U.S. Cl.
CPC ..... *F04C 18/0215* (2013.01); *F04C 18/0261* (2013.01); *F04C 29/026* (2013.01);
(Continued)

(58) Field of Classification Search
CPC ..... F04C 29/02; F04C 29/026; F04C 29/028; F04C 18/0215; F04C 18/0253; F04C 18/0261
See application file for complete search history.

(56) References Cited

U.S. PATENT DOCUMENTS 5,249,941 A * 10/1993 Shibamoto ..... F01C 21/001 418/55.5
8,585,381 B2 * 11/2013 Kiyokawa ..... F04C 29/028 418/55.5
2002/0136654 A1 * 9/2002 Gennami ..... F04C 29/028 418/55.6

FOREIGN PATENT DOCUMENTS

JP 58124083 A * 7/1983 ..... F04C 29/02
JP 59-185892 A 10/1984
(Continued)

OTHER PUBLICATIONS

International Search Report for International Application No. PCT/JP2018/043372, dated Feb. 12, 2019, with an English translation.
(Continued)

*Primary Examiner* — Mark A Laurenzi
*Assistant Examiner* — Xiaoting Hu
(74) *Attorney, Agent, or Firm* — Birch, Stewart, Kolasch & Birch, LLP

(57) ABSTRACT

In the present invention, a fixed scroll (210A) comprises a lubricating oil introduction passage (40) that serves as a first passage for supplying, to the inside of a scroll compressor part (30), a lubricating oil located inside an oil separator that serves as a lubricating oil separation part. An orbiting scroll (210B) comprises a lubricating oil discharge passage (50) that serves as a second passage for discharging, to the outside of the scroll compressor part (30), the lubricating oil which has been introduced to the inside of the scroll compressor part (30).

10 Claims, 6 Drawing Sheets

(52) U.S. Cl.
CPC ..... *F04C 29/028* (2013.01); *F04C 2240/30* (2013.01); *F04C 2240/50* (2013.01); *F04C 2240/60* (2013.01)

(56) References Cited

FOREIGN PATENT DOCUMENTS

| | | | | | |
|---|---|---|---|---|---|
| JP | 60-61493 | U | | 4/1985 | |
| JP | 6-17781 | A | | 1/1994 | |
| JP | 11-30189 | A | | 2/1999 | |
| JP | 11-82335 | A | | 3/1999 | |
| JP | 2001073973 | A | * | 3/2001 | ..... F04C 18/088 |
| JP | 2002-285980 | A | | 10/2002 | |
| JP | 2005-240676 | A | | 9/2005 | |
| JP | 2006241994 | A | * | 9/2006 | ..... F04C 18/0276 |
| JP | 2007-285187 | A | | 11/2007 | |
| JP | 2007291892 | A | * | 11/2007 | ..... F04C 18/088 |
| JP | 2011-174453 | A | | 9/2011 | |

OTHER PUBLICATIONS

Written Opinion of the International Searching Authority for International Application No. PCT/JP2018/043372, dated Feb. 12, 2019, with an English translation.

* cited by examiner

SCROLL COMPRESSOR

TECHNICAL FIELD

The present invention relates to a scroll compressor.

Priority is claimed on Japanese Patent Application No. 2017-229348, filed on Nov. 29, 2017, the content of which is incorporated herein by reference.

BACKGROUND ART

A scroll compressor having a scroll compression part in a closed casing is known. The scroll compression part has a configuration in which a fixed scroll in which a wrap, which is a spiral wall body, is provided to be erected on one side surface of an end plate, and an orbiting scroll in which a wrap having substantially the same shape as the wrap of the fixed scroll is provided to be erected on one side surface of an end plate are engaged with each other.

In the scroll compression part, the orbiting scroll revolves and orbits with respect to the fixed scroll, thereby gradually reducing the volume of a crescent-shaped compression chamber which is formed between a wrap wall body of each scroll and an end plates, and thereby compressing a fluid in the compression chamber.

PTL 1 discloses a compressor provided with a passage for discharging lubricating oil remaining in a compression chamber to the outside of a scroll compression part.

In the compressor disclosed in PTL 1, the discharged lubricating oil is guided to a bearing portion, a mechanism for converting a rotation movement to a revolution movement, or the like (various sliding places where friction occurs when the compressor operates). The periphery (hereinafter, referred to as a "mechanical part") of the bearing portion or the conversion mechanism is a portion that particularly requires lubrication.

CITATION LIST

Patent Literature

[PTL 1] Japanese Unexamined Patent Application Publication No. 2007-285187

SUMMARY OF INVENTION

Technical Problem

Incidentally, not only the mechanical part but also the scroll compression part itself has many sliding places.

For this reason, if the lubricating oil is sufficiently present in the interior of the scroll compression part, not only the efficiency but also the reliability is improved due to a reduction in frictional resistance. In addition, it also contributes to improvement in compression performance such as improvement in sealing property.

However, in the scroll compressor of PTL 1 described above, since the lubricating oil in the interior of the scroll compression part is discharged to a mechanical part which is located outside the scroll compression part, the lubricating oil in the interior of the scroll compression part is relatively reduced, and thus there is a possibility that it may cause a decrease in the reliability or a decrease in compression efficiency of the scroll compression part.

Therefore, the present invention has been made in view of such a problem, and provides a scroll compressor in which it is possible to enhance compression efficiency and it is possible to enhance reliability.

Solution to Problem

The present invention adopts the following means in order to solve the above problems.

A scroll compressor according to an aspect of the present invention includes a closed casing; a rotary shaft rotatable around an axis in the casing; an electric motor which provides a rotating force to the rotary shaft; a bearing portion which rotatably supports the rotary shaft; a scroll compression part which includes a compression chamber which is connected to the rotary shaft through a conversion mechanism for converting a rotation movement of the rotary shaft to a revolution movement and compresses a fluid by operating by the rotating force of the rotary shaft; and a lubricating oil separation part which is provided outside the scroll compression part and separates lubricating oil contained in the compressed fluid compressed by the scroll compression part and discharged to the outside of the scroll compression part, in which the compression part has a fixed scroll which has an end plate on which a wall body is provided to be erected in a spiral shape, and is fixed to and internally provided in the casing, and an orbiting scroll which has an end plate on which a wall body is provided to be erected in a spiral shape, and is revolvably supported in the casing to face the fixed scroll in a state where the wall body thereof is engaged with the wall body of the fixed scroll, the fixed scroll includes a first passage for supplying the lubricating oil separated in an interior of the lubricating oil separation part to the interior of the scroll compression part, and the orbiting scroll includes a second passage for discharging the lubricating oil introduced to the interior of the scroll compression part to the outside of the scroll compression part.

According to the present invention, the first passage for supplying the lubricating oil to the interior of the scroll compression part is provided, whereby it becomes possible to improve the sealing property of the compression chamber and improve the sliding, and therefore, the compression efficiency can be enhanced.

Further, the second passage for discharging the lubricating oil introduced to the interior of the scroll compression part to the outside of the scroll compression part is provided, whereby the lubricating oil can be directly discharged the outside (for example, the mechanical part (a sliding part such as a drive part or a pressure receiving part outside the compression chamber)) of the scroll compression part, and therefore, reliability can be enhanced.

Further, in the scroll compressor described above, when the compression chamber formed to be interposed between the wall bodies in a plan view of the end plate moves toward a shaft center while orbiting around the shaft center along the wall body during an operation of the scroll compression part, both the first passage and the second passage may be open to a spiral area that is an area surrounded by an envelope of a trajectory which is drawn by the compression chamber due to the movement.

With such a configuration, it becomes possible to supply the lubricating oil to the interior of the compression chamber, which is formed when the scroll compression part is operated, and gradually contracts while moving, and discharge the lubricating oil in the interior of the compression chamber.

In this way, the lubricating oil can be efficiently supplied to the spiral area, and the supply amount and discharge amount of the lubricating oil with respect to the spiral area can be optimized.

Further, in the scroll compressor described above, when a movement of the fluid moving in the spiral area toward the shaft center while orbiting around the shaft center during an operation of the scroll compression part is a flow from an upstream side to a downstream side, an opening of the first passage on the interior side of the scroll compression part may be provided on a further upstream side of the flow than an opening of the second passage on the interior side of the scroll compression part.

According to this configuration, the lubricating oil introduced from the first passage moves while lubricating the scroll compression part without opposing a spiral shape flow of a working fluid which is generated by the operation of the scroll compression part, and is then discharged from the second passage. For this reason, it is possible to make both the supply and the discharge of the lubricating oil smooth without using any special additional means.

Further, in the scroll compressor described above, one or both of the openings of the first passage and the second passage on the interior side of the scroll compression part may be provided on the end plate.

With such a configuration, an opening is formed on the same surface as the sliding surface between the tip surface of the wall body (wrap portion), which is a portion of the scroll compression part, in which lubrication is more required, and the end plate of the orbiting scroll.

In this way, since a movement path of the lubricating oil is formed on the sliding surface, the lubrication of the sliding surface is promoted, or the supply, movement, and discharge of the lubricating oil can be more smoothly performed.

Further, in the scroll compressor described above, in a case where a boundary line on an inner peripheral side of the trajectory is drawn by a wall surface of the wall body of the fixed scroll in the compression chamber, an opening on the compression chamber side of the first passage, which is open to the compression chamber describing the trajectory, may be provided on a wall surface on a radially outward side of the wall body of the fixed scroll or in an end plate in the vicinity of the wall surface, and in a case where a boundary line on an outer peripheral side of the trajectory is drawn by a wall surface of the wall body of the fixed scroll in the compression chamber, an opening on the compression chamber side of the first passage, which is open to the compression chamber describing the trajectory, may be provided on a wall surface on a radially inward side of the wall body of the fixed scroll or in an end plate in the vicinity of the wall surface.

With this configuration, even if the compression chamber is reduced with the revolution of the orbiting scroll by the operation of the scroll compression part, the continuous opening time of the first passage can be lengthened, and therefore, the supply of the lubricating oil to the compression chamber can be made smoother.

Further, with the above configuration, it becomes possible to form a movement path of the lubricating oil in the vicinity of the wall body or on the wall body, and therefore, the lubrication in the contact place between the wall bodies can be promoted and the sealing property can be improved.

Further, in the scroll compressor described above, in a case where a boundary line on an inner peripheral side of the trajectory is drawn by a wall surface of the wall body of the fixed scroll in the compression chamber, an opening on the compression chamber side of the second passage, which is open to the compression chamber describing the trajectory, may be provided on a wall surface on a radially inward side of the wall body of the orbiting scroll or in an end plate in the vicinity of the wall surface, and in a case where a boundary line on an outer peripheral side of the trajectory is drawn by a wall surface of the wall body of the fixed scroll in the compression chamber, an opening on the compression chamber side of the second passage, which is open to the compression chamber describing the trajectory, may be provided on a wall surface on a radially outward side of the wall body of the orbiting scroll or in an end plate in the vicinity of the wall surface.

With such a configuration, even if the compression chamber is reduced with the revolution of the orbiting scroll by the operation of the scroll compression part, the continuous opening time of the second passage can be lengthened. In this way, the discharge of the lubricating oil from the compression chamber and the supply of the lubricating oil to the mechanical part can be made smoother.

Further, in the scroll compressor described above, openings of the first passage and the second passage on the interior side of the scroll compression part may be provided at positions where both the first passage and the second passage can simultaneously communicate with one compression chamber of the compression chambers by a movement of the compression chamber by an operation of the scroll compression part.

With such a configuration, it becomes possible to take time to simultaneously perform both the supply of the lubricating oil to the compression chamber and the discharge of the lubricating oil from the compression chamber.

In this way, it becomes possible to reduce variation of the total amount of the lubricating oil existing in the interior of the scroll compression part, and therefore, it is possible to avoid an excessive state or an insufficient state of the lubricating oil in the interior of the scroll compression part.

Further, in the scroll compressor described above, an end plate protrusion region, which is a region protruding toward the opposing end plate, in the surface of the end plate on a side where the wall body is provided to be erected, and a step portion extending along a boundary of the end plate protrusion region may be provided on the end plate, and an opening of the second passage on the interior side of the scroll compression part may be provided in the vicinity of the step portion and outside the end plate protrusion region.

According to this configuration, the opening of the second passage is provided in the vicinity of the step portion. In a scroll-type scroll compression part in which compression can be performed not only in the radial and circumferential directions of a scroll but also in the axial direction, the step portion is a portion where lubricating oil is more likely to be unevenly distributed and a seal is required. In this way, it becomes possible to discharge the lubricating oil from the step portion where the lubricating oil is more abundant due to the provision of the first opening, and therefore, the discharge of the lubricating oil and the supply of the lubricating oil to the mechanical part can be performed more smoothly. Further, since the first opening is provided, more lubricating oil moves to the step portion, and therefore, the lubricity and sealing property of the step portion are also secured.

Advantageous Effects of Invention

According to the present invention, it is possible to enhance the compression efficiency of a compressor and to enhance the reliability of the compressor.

DESCRIPTION OF EMBODIMENTS

First Embodiment

Hereinafter, a first embodiment of the present invention will be described in detail with reference to the drawings.

Figure 1:
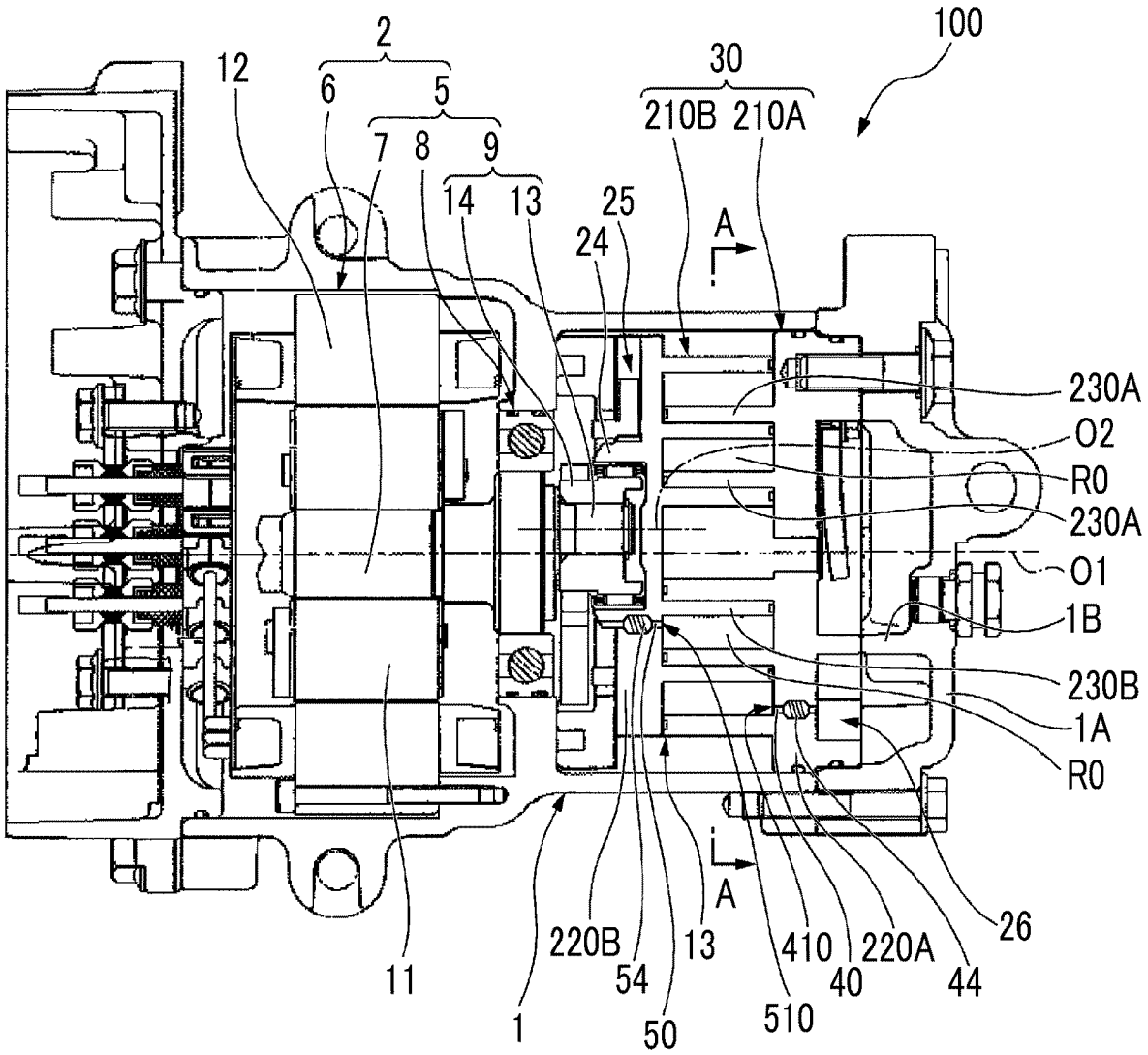
FIG. 1 is a sectional view of a scroll compressor according to a first embodiment of the present invention.

A scroll compressor 100 of the embodiment shown in FIG. 1 is connected to, for example, a refrigerant circuit of a refrigerating apparatus, and is used to compress a refrigerant gas.

The scroll compressor 100 includes a casing 1, a drive part 2 accommodated in the casing 1, a scroll compression part 30, and an oil separator (a lubricating oil separation part). The casing 1 forms the outer shape of the scroll compressor 100 and hermetically accommodates various internal mechanisms other than a suction place and a discharge place for a working fluid.

The casing 1 has a substantially cylindrical shape and is long in a direction of extension of a central axis of the cylindrical shape, and the casing 1 accommodates the drive part 2, the scroll compression part 30, and the oil separator disposed in series in this order and in the direction described above.

The drive part 2 has a mechanical part 5 and an electric motor 6.

The mechanical part 5 includes a rotary shaft 7, a bearing portion 8, and a conversion mechanism 9 that converts a rotation movement around a rotational axis O1 of the rotary shaft 7 to a revolution movement. The mechanical part 5 is connected to the scroll compression part 30 by the conversion mechanism 9, converts the rotation movement of the rotary shaft 7 to a revolution movement in the conversion mechanism 9, and transmits the revolution movement to the scroll compression part 30.

The electric motor 6 provides a rotating force to the rotary shaft 7 supported by the bearing portion 8 so as to be able to rotate around the rotational axis O1. The electric motor 6 includes a rotor core 11 and a stator core 12.

The rotor core 11 is fixed to a central portion of the rotary shaft 7 so as to surround the rotary shaft 7 in a rotational direction (a circumferential direction), and has a substantially cylindrical shape having the same central axis as the rotational axis O1. The stator core 12 is fixed to the inner wall surface of the casing so as to surround the rotor core 11 in the circumferential direction from the outer peripheral side, and has a substantially cylindrical shape likewise having the rotational axis O1 as a central axis. The electric motor 6 is connected to a power source, and converts electric power to a rotating force, thereby rotating the rotary shaft 7 around the rotational axis O1.

The conversion mechanism 9 has an eccentric part 13 and a drive bush 14.

The eccentric part 13 is a cylindrical member fixed to the end on the scroll compression part 30 side of the rotary shaft 7. An extension direction of a center axis of the eccentric part 13 is parallel to the rotational axis O1 of the rotary shaft 7, and since a finite distance is provided between an eccentric axis and the rotational axis O1, the eccentric part 13 rotates around the rotational axis O1 with the rotation of the rotary shaft 7.

The drive bush 14 is a substantially cylindrical member fixed to the eccentric part 13 so as to surround the eccentric part 13, and the central axis of the drive bush 14 is an eccentric axis O2. The drive bush 14 rotates around the rotational axis O1 integrally with the eccentric part 13.

As described above, the rotating force which is provided to the rotary shaft 7 by the electric motor 6 is converted to a revolution movement of the drive bush 14.

Before the scroll compression part 30 according to the first embodiment of the present invention is described in detail with reference to FIGS. 1, 3, and 4, a compression chamber R, a compression chamber R0, and a compression chamber R1 shown in FIG. 3 will be described.

The compression chamber R0 is a general term for a crescent-shaped space. In the case of FIG. 3, there are five compression chambers R0.

The compression chamber R indicates a compression chamber which is located at a position where a spiral areas D can be drawn by contraction from the compression chamber R0, among the five compression chambers R0. In the case of FIG. 3, there are a total of two compression chambers R. Then, the compression chamber R moves inward, whereby the spiral areas D (a fixed scroll outer wall-side spiral area D1 and a fixed scroll inner wall-side spiral area D2) are drawn.

Figure 3:
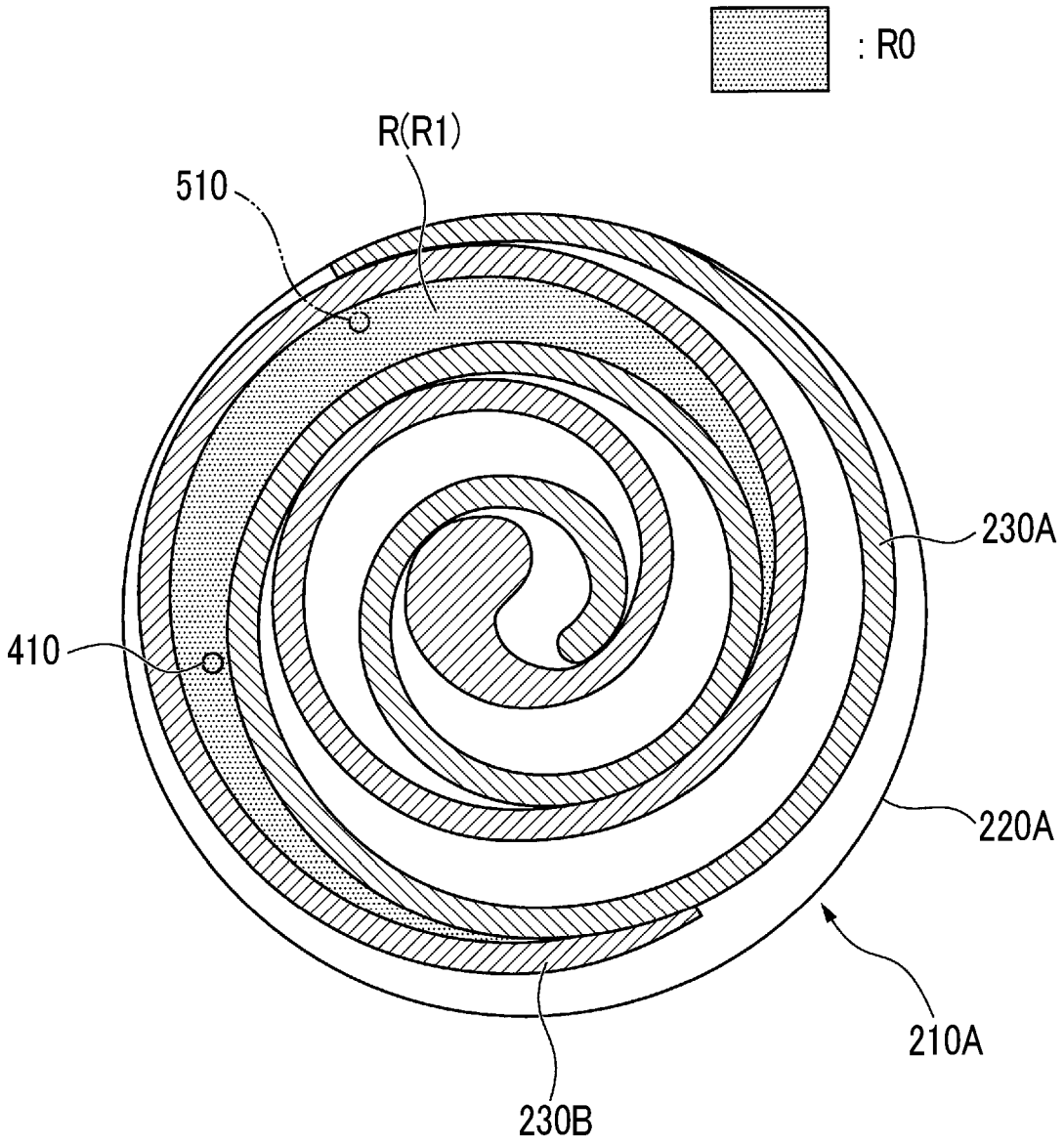
FIG. 3 is a cross-sectional view taken along line A-A of the scroll compressor according to the first embodiment of the present invention, in which a lubricating oil discharge port is added.

The compression chamber R1 indicates a specific one compression chamber R of the compression chambers R (in the case of FIG. 3, one compression chamber R of the two compression chambers R).

The scroll compression part 30 has a fixed scroll 210A and an orbiting scroll 210B.

The fixed scroll 210A has a fixed end plate 220A (an end plate) and a fixed wrap 230A. The fixed end plate 220A is a disk-shaped metal plate, and the fixed wrap 230A is fixedly provided on one surface of the fixed end plate 220A. The fixed wrap 230A is a wall body that stands upright from the fixed end plate 220A, and has a constant height in an upright direction. Further, in a state where the fixed end plate 220A is viewed in a plan view, the fixed wrap 230A is provided in a spiral shape. As an example, this spiral shape has an involute curve centered on the center of the fixed end plate 220A.

The orbiting scroll 210B has an orbiting end plate 220B (an end plate) and an orbiting wrap 230B. The orbiting end plate 220B is a disk-shaped metal plate, and the orbiting wrap 230B is fixedly provided on one surface of the orbiting end plate 220B. The orbiting wrap 230B is also a wall body that stands upright from the orbiting end plate 220B, and has a constant height in the upright direction. This height is the same as the height of the fixed wrap 230A. Further, the orbiting wrap 230B is provided in a spiral shape when the orbiting end plate 220B is viewed in a plan view. As an example, the spiral shape has an involute curve centered on the center of the orbiting end plate 220B.

The fixed scroll 210A is fixed to the inner wall surface of the casing so as to share the rotational axis O1 as the central axis thereof.

The orbiting scroll 210B is supported so as to be able to revolve with respect to the fixed scroll 210A in a state where wrap tip surfaces which are the tops of the wall bodies of each other are in contact with, that is, meshed with the end plates 220 of each other while the surface of the fixed end plate 220A on which the fixed wrap 230A is provided to be erected and the surface of the orbiting end plate 220B on the side where the orbiting wrap 230B is provided to be erected face each other. At this time, the orbiting end plate 220B is supported so as to share the eccentric axis O2 as the central axis thereof.

A boss part 24 is provided on the surface of the orbiting end plate 220B on which the orbiting wrap 230B is not provided to be erected.

The boss part 24 is a cylindrical member that shares as the central axis thereof, the eccentric axis O2 that is also the central axis of the drive bush 14 of the conversion mechanism 9 described above, and is provided to be erected vertically with respect to the orbiting end plate 220B integrally with the orbiting end plate 220B. The drive bush 14 is fitted to the boss part 24 so as to be relatively rotatable around the eccentric axis O2, whereby the revolution movement of the drive bush 14 is transmitted to the boss part 24 of the orbiting end plate 220B, and therefore, the orbiting scroll 210B revolves with respect to the fixed scroll 210A. Here, the rotation of the orbiting scroll 210B is prohibited by an Oldham coupling 25.

As described above, the rotation movement of the rotary shaft 7 is converted to the revolution movement through the conversion mechanism 9, and then transmitted to the orbiting scroll 210B. In this way, the compression chamber R0, which is a crescent-shaped space formed by the two wraps 230 and the end plates 220, contracts while moving while drawing a vortex toward the center of the end plate 220 while orbiting around the rotational axis O1, whereby a fluid such as a refrigerant gas can be compressed.

A discharge chamber configured by the side of the fixed end plate 220A where the fixed wrap 230A is not provided and a casing wall 1A is provided, and an oil separator (not shown) is provided on the casing wall.

Specifically, a centrifugal oil separator or the like is generally known, and a fluid containing a mixture of high-pressure gas and lubricating oil is introduced into an oil separator having a cylindrical space and a separation pipe smaller in diameter than a space which is disposed concentrically with the cylindrical space, so as to form a swirling flow, and after the gas and the lubricating oil are separated from each other by a centrifugal force, the gas is discharged from the separation pipe on one side and the lubricating oil is discharged from an oil discharge hole on the other side.

The refrigerant gas compressed by the operation of the scroll compression part 30 is discharged from a discharge hole provided at the central portion of the fixed scroll 210A to a discharge chamber outside the scroll compression part 30 through an ejection valve provided on the side of the fixed end plate 220A where the fixed wrap 230A is not provided, and is led from a passage (not shown) provided in a casing partition 1B to the interior of the oil separator. The oil separator separates the lubricating oil contained in the introduced refrigerant gas, discharges the refrigerant gas out of the compressor, and stores the lubricating oil as a lubricating oil reservoir in the interior.

Here, in this embodiment, the fixed scroll 210A is provided with a lubricating oil introduction passage 40 (a first passage) for introducing the lubricating oil in the interior of the oil separator into the interior of the compression chamber R0, and the orbiting scroll 210B is provided with a lubricating oil discharge passage 50 (a second passage) for discharging the lubricating oil introduced into the interior of the compression chamber R0 to the outside of the compression chamber R0.

The lubricating oil introduction passage 40 is provided to penetrate the fixed end plate 220A from a bottom side of a recessed portion 26 of the fixed scroll 210A toward the side where the fixed wrap 230A is provided, that is, toward the compression chamber R0 side. A throttle 44 for providing a flow path resistance to the lubricating oil which is introduced is provided in the middle of the lubricating oil introduction passage 40. An opening (a lubricating oil supply port 410) on the compression chamber R0 side of the lubricating oil introduction passage 40 is located on the fixed end plate 220A in the vicinity of the root of the fixed wrap 230A.

The lubricating oil discharge passage 50 is provided to penetrate the orbiting end plate 220B from the compression chamber R0 side of the orbiting scroll 210B toward the side where the orbiting wrap 230B is not provided, that is, toward the mechanical part 5 side. An opening (a lubricating oil discharge port 510) on the compression chamber R0 side of the lubricating oil discharge passage 50 is located on the orbiting end plate 220B near the root of the orbiting wrap. A throttle 54 for providing a flow passage resistance to the lubricating oil which is introduced is also provided in the middle of the lubricating oil discharge passage 50. Here, it is preferable to set the flow path resistance of each throttle such that the lubricating oil which is introduced into the compression chamber R0 and the lubricating oil which is discharged therefrom become as equal as possible.

Hereinafter, the position of each of the lubricating oil supply port 410 and the lubricating oil discharge port 510 and the relationship between the positions will be described in detail with reference to FIGS. 2 to 5.

Figure 4:
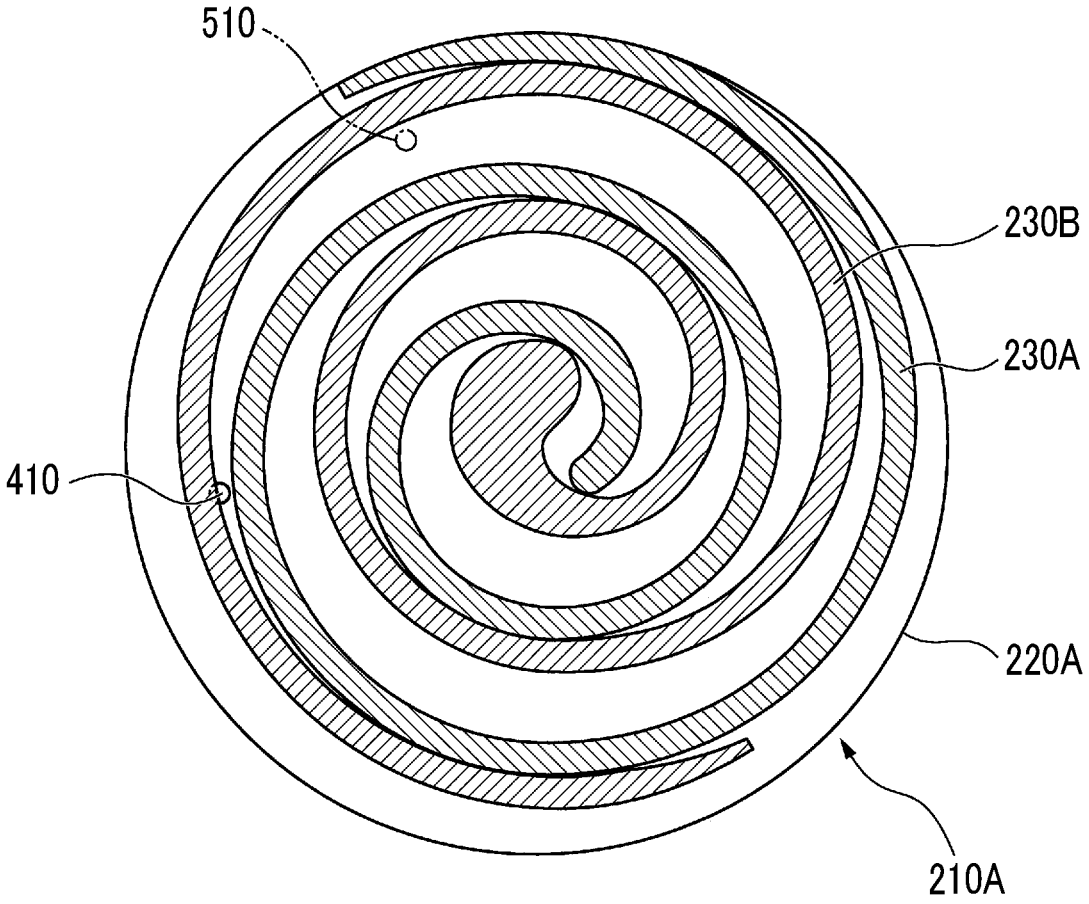
FIG. 4 is a cross-sectional view taken along line A-A of the scroll compressor according to the first embodiment of the present invention, in which an orbiting scroll is turned by about ⅙ turn from the state of FIG. 3.
Figure 5:
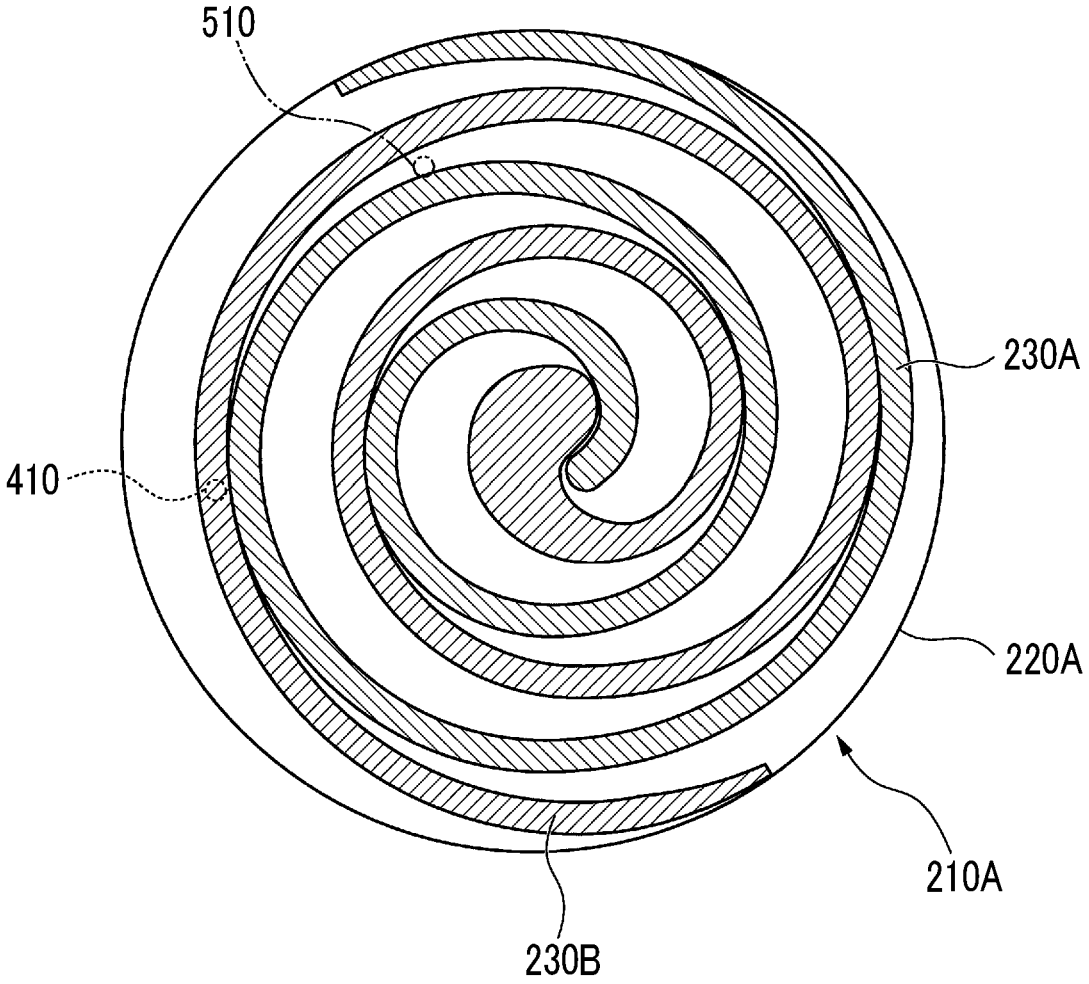
FIG. 5 is a cross-sectional view taken along line A-A of the scroll compressor according to the first embodiment of the present invention, in which the orbiting scroll is further turned by about ⅙ turn from the state of FIG. 4.

As shown in FIGS. 3 to 5, when the fixed scroll 210A is viewed in a plan view from the orbiting scroll 210B side, during the operation, the crescent-shaped compression chamber R is directed toward a shaft center while orbiting around the shaft center, thereby moving while contracting the volume thereof. At this time, when a section which is configured by an envelope of a trajectory of the crescent-shaped compression chamber on the scroll end plate is set to be the spiral area D, both the lubricating oil supply port 410 and the lubricating oil discharge port 510 are open to the spiral area D.

Figure 2:
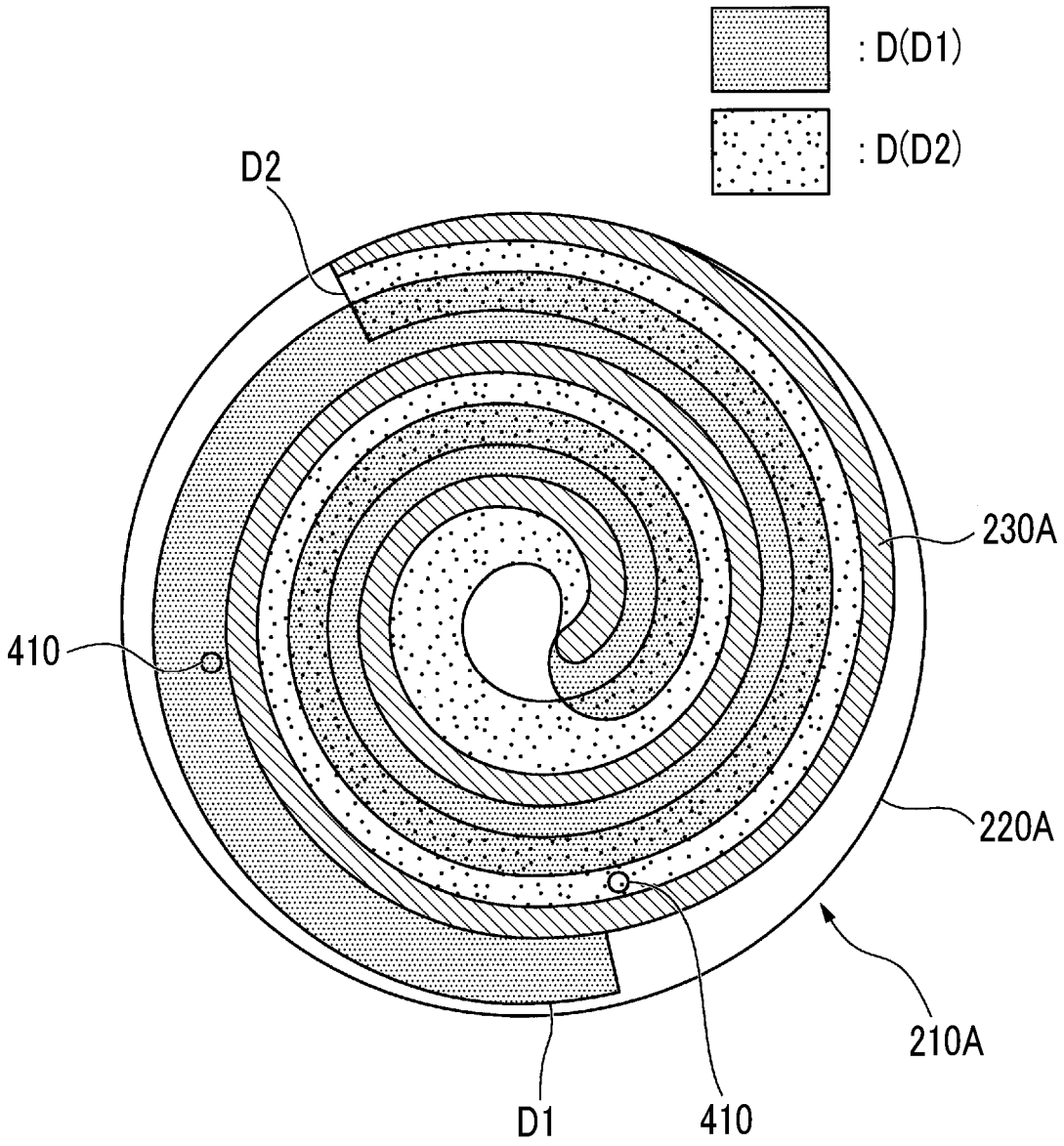
FIG. 2 is a cross-sectional view taken along line A-A of the scroll compressor according to the first embodiment of the present invention and shows only a fixed scroll.

FIG. 2 shows the above-described spiral areas D (the fixed scroll outer wall-side spiral area D1 and the fixed scroll inner wall-side spiral area D2) by using the fixed scroll as an example. The refrigerant gas is compressed as it goes toward the central portion by following the spiral path along the spiral area D. In this embodiment, the lubricating oil supply port 410 is provided on the upstream side (outward side) of this area, and the lubricating oil discharge port 510 is provided further on the downstream side (inward side) than the lubricating oil supply port 410. Further, the distance between these openings is a distance in which both the lubricating oil supply port 410 and the lubricating oil discharge port 510 can be open to the same compression chamber R1 when the scroll compression part 30 operates.

Here, as shown in FIG. 2, in the scroll compressor 100 of this embodiment, there are two spiral areas D described above.

That is, there are the fixed scroll outer wall-side spiral area D1 which is formed by the envelope of the trajectory of the compression chamber which is configured by the outer arc of the fixed scroll wrap, and the fixed scroll inner wall-side spiral area D2 which is formed by the envelope of the trajectory of the compression chamber which is configured by the inner arc of the fixed scroll wrap. The two spiral areas D overlap each other at the central portion between the fixed wraps 230A.

In this embodiment, the lubricating oil supply port 410 corresponding to each of the fixed scroll outer wall-side spiral area D1 and the fixed scroll inner wall-side spiral area D2 is open to both the areas and is not open to the area where the flow paths overlap.

Hereinafter, for the sake of simplicity, in FIGS. 3 to 5, the positional relationship and functions of the lubricating oil supply port 410 and the lubricating oil discharge port 510 which are open to the fixed scroll outer wall-side spiral area D1 in FIG. 2 will be described in detail, by taking the lubricating oil supply port 410 and the lubricating oil discharge port 510 as an example.

As shown in FIG. 3, when the volume of the compression chamber R0 passing over the fixed scroll outer wall-side spiral area D1 is the maximum, both the lubricating oil supply port 410 and the lubricating oil discharge port 510 are open to the compression chamber R1. FIG. 4 shows a state where the orbiting scroll 210B has been turned by about ⅙ turn in the direction of compressing the refrigerant gas from the state shown in FIG. 3. In this embodiment, the lubricating oil supply port 410 is provided at a position adjacent to the fixed wrap 230A on the end plate of the fixed scroll 210A, and therefore, even if the orbiting wrap 230B approaches the fixed wrap 230A, the lubricating oil supply port 410 is not closed during the period from the state of FIG. 3 to the state of FIG. 4.

Similarly, FIG. 5 shows a state where the orbiting scroll 210B has been further turned by about ⅙ turn in the direction of compressing the refrigerant gas from the state shown in FIG. 4. In this embodiment, the lubricating oil discharge port 510 is provided at a position adjacent to the orbiting wrap 230B on the end plate of the orbiting scroll 210B, and therefore, even if the orbiting wrap 230B approaches the fixed wrap 230A, the lubricating oil discharge port 510 is not closed during the period from the state of FIG. 3 to the state of FIG. 5.

As described above, although the lubricating oil supply port 410 and the lubricating oil discharge port 510 are provided at positions where there is a case where the ports are closed by the scroll wraps 230 facing each other during the operation, the ports are disposed such that an opening lasts longer.

In the scroll compressor 100 having the configuration described above, the lubricating oil introduction passage 40 for introducing the lubricating oil separated in the oil separator into the interior of the compression chamber R is provided in the fixed scroll 210A, and therefore, lubrication of a member configuring the compression chamber R is promoted. In this way, even if the lubricating oil in the interior of the compression chamber R is discharged to the outside of the compression chamber R through the lubricating oil discharge passage 50, the lubrication of the scroll compression part 30 and the sealing property of the compression chamber R are secured, and therefore, the reliability of the scroll compression part 30 is improved and the compression efficiency can be improved. Further, since the lubricating oil discharged from the compression chamber R is supplied to the bearing portion 8 or the conversion mechanism 9, reliability and operation efficiency are improved due to improvement in the lubricity of the mechanical part 5.

Further, in the scroll compressor 100 having the configuration described above, the lubricating oil can be supplied into one compression chamber R1 which is formed by the operation of the scroll compression part 30, and the lubricating oil can be discharged from the compression chamber R1. In this way, the lubrication of the movement of each compression chamber R is promoted, the sealing property is improved, and the excessive supply amount and discharge amount of the lubricating oil in each compression chamber R1 unit are suppressed, and the amount of lubricating oil in each compression chamber R1 unit can be optimized.

Further, as described above, since the lubricating oil supply port 410 is provided on the upstream side of the spiral area D and the lubricating oil discharge port 510 is provided on the downstream side, the lubricating oil is guided along the flow of the working fluid, and therefore, the supply and the discharge of the lubricating oil can be facilitated without using any special means.

Further, in the scroll compressor 100 according to this embodiment, the lubricating oil supply port 410 and the lubricating oil discharge port 510 are provided adjacent to the wraps 230 on the scrolls of each other. For this reason, the opening to the compression chamber R1 can be continued for a longer time even during the operation of the scroll compression part 30. In this way, it is possible to more smoothly perform the supply and discharge of the lubricating oil.

In addition, in the scroll compressor 100 according to this embodiment, both the lubricating oil supply port 410 and the lubricating oil discharge port 510 are provided at positions where the ports can be open to the same certain compression chamber R1. In this way, it is possible to secure the time during which the supply and the discharge of the lubricating oil are performed at the same time, and therefore, it is possible to avoid an excessive amount and an insufficient amount of the lubricating oil in the interior of the scroll compression part 30, and it is possible to perform the operation with higher reliability.

Accordingly, the scroll compressor 100 according to this embodiment can improve the lubricity of the mechanical part 5 in addition to improvement in the lubricity and the sealing property in the scroll compression part 30, as described above, and therefore, the reliability and efficiency of the compressor can be improved.

Further, in the scroll compressor 100, the lubricating oil supply port 410 is provided at an end plate portion further outward than the outer end portion of the fixed wrap 230A, and in the vicinity of the outside of the wall surface of the fixed wrap 230A, and the outer end portion of the orbiting wrap 230B is provided in the vicinity of a position immediately below in the vertical direction (FIGS. 3 to 6). In this case, even in a case where a large amount of lubricating oil separated in the oil separator is supplied into the compression chamber R when the scroll compressor 100 is stopped, the lubricating oil easily flows from the outer end portion of the orbiting wrap 230B to the outside of the compression chamber by gravity, and at the time of subsequent restart, a so-called liquid compression, in which a start is performed while the compression chamber is in a liquid-sealed state, does not easily occur, and thus advantages can also be obtained in terms of noise or reliability.

Second Embodiment

Figure 6:
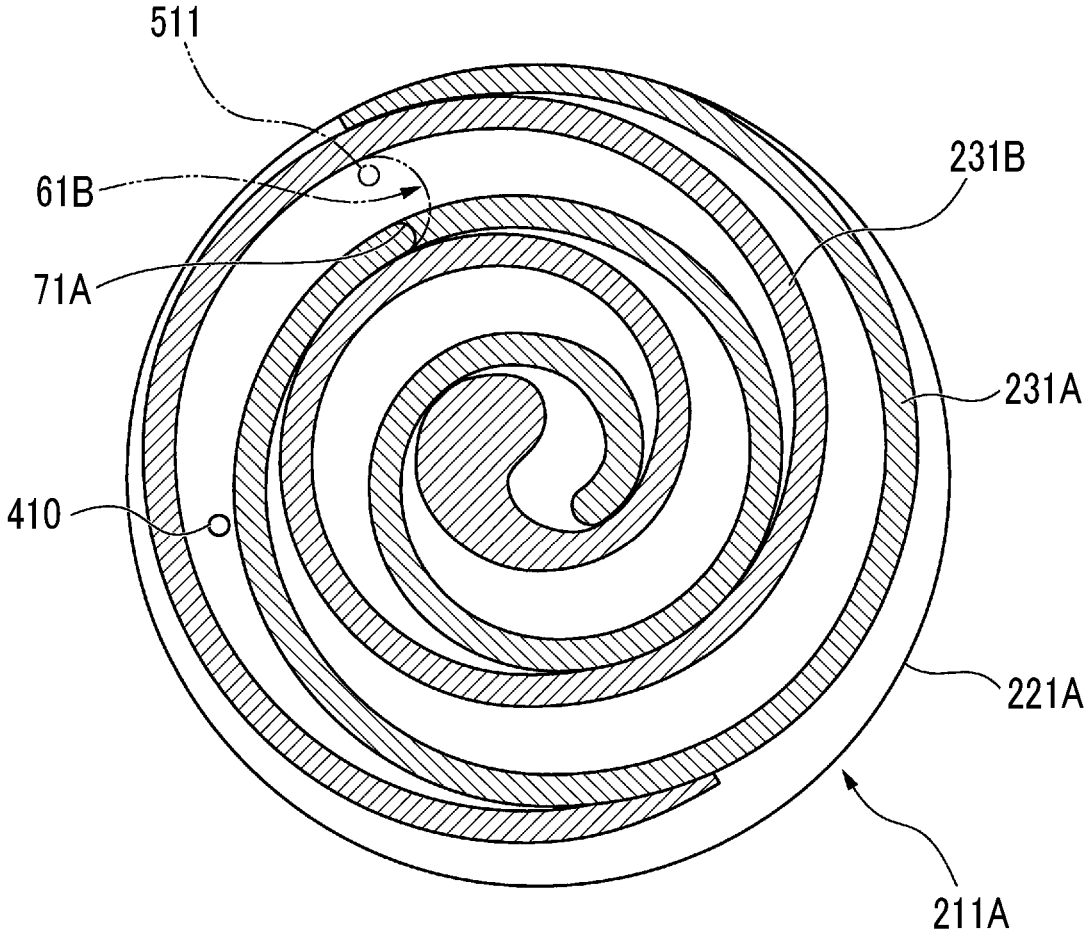
FIG. 6 is a cross-sectional view of a scroll compression part included in a scroll compressor according to a second embodiment of the present invention.

Next, a scroll compressor 300 according to a second embodiment will be described with reference to FIG. 6. In FIG. 6, only a scroll compression part 350 among the constituent elements of the scroll compressor 300 is shown.

In FIG. 6, the same components as those of the scroll compressor 100 according to the first embodiment are denoted by the same reference numerals.

The scroll compressor 300 according to the second embodiment has the same configuration as the scroll compressor 100 except that the scroll compressor 300 has the scroll compression part 350 instead of the scroll compression part 30 included in the scroll compressor 100 of the first embodiment.

In the second embodiment, a central portion of an orbiting end plate 221B or a fixed end plate 221A is a protrusion portion that protrudes in a trapezoidal shape in a direction in which an orbiting wrap 231B or a fixed wrap 231A is provided to be erected (in this embodiment, an example in which the central portion of the orbiting end plate 221B is a protrusion portion is shown). The top of the protrusion portion is a flat surface parallel to the orbiting end plate 221B, and the parallel flat surface is an end plate protrusion region P. A semicircular orbiting scroll step portion 61B is provided at the boundary between the end plate protrusion region P and the outside of the region in the orbiting end plate 221B.

On the other hand, the height of the fixed wrap 231A of a fixed scroll 210A is low at the central portion and high at the outer portion with a step 71A as a boundary. The wrap heights at the central portion and the outer portion in the fixed end plate 221A of the fixed scroll 211A are set to conform to the thickness of the orbiting end plate 221B of the orbiting scroll 211B in a case where the fixed scroll 211A and the orbiting scroll 211B are combined.

The orbiting scroll step portion 61B is provided in the middle of a spiral, area interposed between the orbiting wrap 231B and the fixed wrap 231A on the orbiting end plate 221B (not shown). A stepped surface connecting the end plate protrusion region P and the outside of the region is upright with respect to the end plate in the same direction as the extending direction of the wrap 231, and extends in a semicircular shape bulging toward the downstream side of the spiral area D in a plan view of the end plate.

In this embodiment, similar to the first embodiment, a lubricating oil discharge port 511 is located adjacent to the orbiting wrap 231B, is in the vicinity of the orbiting scroll step portion 61B in the orbiting end plate 221B, and is provided on the orbiting end plate 221B outside the end plate protrusion region P. The positional relationships of the respective other openings are the same as in the first embodiment.

In the compressor 101 having the configuration described above, the lubricating oil discharge port 511 is located in the vicinity of the orbiting scroll step portion 61B in the orbiting end plate 221B and can effectively discharge the lubricating oil that tends to be unevenly distributed outside the end plate protrusion region P. In this way, the discharge of the lubricating oil is promoted, and the lubricating oil can be more efficiently supplied to the mechanical part 5. Further, since the lubricating oil supply port 410 is also provided on the upstream side of the spiral area D, the lubrication and the sealing property in the vicinity of the orbiting scroll step portion 61B, which is a region where the demand for lubrication and sealing is higher in view of the nature of the compressor 101 having the above configuration, are also secured.

Accordingly, even in the scroll compression part 350 enabling three-dimensional compression as described above, the lubricity and the sealing property are improved, so that the lubricity of the mechanical part 5 can be enhanced, and therefore, the reliability and efficiency of the compressor 101 can be improved.

The first embodiment and the second embodiment of the present invention have been described in detail above with reference to the drawings. However, the specific configurations are not limited to these embodiments, and a design change and the like within a scope which does not depart from the gist of the present invention are also included.

For example, a plurality of lubricating oil supply ports 410 and a plurality of lubricating oil discharge ports 511 may be provided for each corresponding spiral area, and a plurality of lubricating oil introduction passages 40 and a plurality of lubricating oil discharge passages 50 may be likewise provided.

In the embodiment described above, the lubricating oil supply port 410 and the lubricating oil discharge port 511 are provided on the end plate 220. However, there is no limitation thereto, and the lubricating oil supply port 410 and the lubricating oil discharge port 511 may be open on the wall surface of the wrap 230, or may be open from the tip of the wrap 230. Further, the lubricating oil discharge port led from the compression chamber R by the lubricating oil discharge passage 50 may be open in a boss portion of the orbiting scroll 210B.

Further, in the second embodiment, an example is shown in which the central portion of the orbiting end plate 221B is a protrusion portion. However, the central portion of the fixed end plate 221A may also be a protrusion portion. In this case, in the present invention, regarding the configuration of the end plate, the wrap, or the like which is included in the fixed scroll 221A and the orbiting scroll 221B described in the second embodiment, it goes without saying that it further has a configuration in which the configuration on the fixed side is provided on the orbiting side and the configuration on the orbiting side is provided on the fixed side.

Further, in each of the embodiments described above, the compressor which is driven by the electric motor 6 has been described in detail. However, regarding a driving force, a compressor that directly obtains a driving force from, for example, an engine is also acceptable.

Further, the oil separator may be of a type other than the centrifugal type.

INDUSTRIAL APPLICABILITY

The present invention is applicable to a scroll compressor.

REFERENCE SIGNS LIST

1: casing
1A: casing wall
1B: casing partition
2: drive part
4: oil separator
5: mechanical part
6: electric motor
7: rotary shaft
8: bearing portion
9: conversion mechanism
11: rotor core

12: stator core
13: eccentric part
14: drive bush
24: boss part
25: Oldham coupling
26: recessed portion
30, 350: scroll compression part
40: lubricating oil introduction passage
50: lubricating oil discharge passage
44, 54: throttle
61B: orbiting scroll step portion
51: protrusion portion
71A: fixed wrap tip step portion
81: stepped surface
100, 300: scroll compressor
210A: fixed scroll
210B: orbiting scroll
220A: fixed end plate
220B: orbiting end plate
230A: fixed wrap
230B: orbiting wrap
410: lubricating oil supply port
510: lubricating oil discharge port
D: spiral area
D1: fixed scroll outer wall-side spiral area
D2: fixed scroll inner wall-side spiral area
O1: rotational axis
O2: eccentric axis
P: end plate protrusion region
R, R1: compression chamber

The invention claimed is:

1. A scroll compressor comprising:

a closed casing;

a rotary shaft rotatable around an axis in the casing;

a bearing portion which rotatably supports the rotary shaft;

a scroll compression part which includes a compression chamber which is connected to the rotary shaft through a converter for converting a rotation movement of the rotary shaft to a revolution movement and compresses a fluid by operating by a rotating force of the rotary shaft, the converter having an eccentric part connected to the rotary shaft, and a drive bush surrounding the eccentric part; and a lubricating oil separation part which is provided downstream of the scroll compression part and separates lubricating oil contained in the compressed fluid compressed by the scroll compression part and discharged to the outside of the scroll compression part, wherein the scroll compression part includes a fixed scroll which has a first end plate on which a first wall body is provided to be erected in a spiral shape, and is fixed to and internally provided in the casing, and an orbiting scroll which has a second end plate on which a second wall body is provided to be erected in a spiral shape, and is revolvably supported in the casing to face the fixed scroll in a state where the second wall body thereof is engaged with the first wall body of the fixed scroll, the fixed scroll has a plurality of first passages for supplying the lubricating oil in an interior of the lubricating oil separation part to an interior of the scroll compression part, the orbiting scroll has a second passage for discharging the lubricating oil introduced into the interior of the scroll compression part to the outside of the scroll compression part, the scroll compressor includes a first area described by an envelope of a first trajectory of the compression chamber, which is formed by an outer arc of the first wall body of the fixed scroll, and a second area described by an envelope of a second trajectory of the compression chamber, which is formed by an inner arc of the first wall body of the fixed scroll, and each of the plurality of first passages is formed so as to not be opened in an area in which the first and second areas are overlapped with each other.

2. The scroll compressor according to claim 1, wherein when the compression chamber formed to be interposed between the first and second wall bodies in a plan view of the first and second end plates moves toward a shaft center while orbiting around the shaft center along the first and second wall bodies during an operation of the scroll compression part, both the plurality of first passages and the second passage are open to a spiral area that is an area surrounded by the envelope of the first trajectory or the envelope of the second trajectory drawn by the compression chamber due to the movement.

3. The scroll compressor according to claim 2, wherein when a movement of the fluid moving in the spiral area toward the shaft center while orbiting around the shaft center during the operation of the scroll compression part is a flow from an upstream side to a downstream side, an opening of at least one first passage of the plurality of first passages on the interior side of the scroll compression part is provided on a further upstream side of the flow than an opening of the second passage on the interior side of the scroll compression part.

4. The scroll compressor according to claim 2, wherein one or both of the openings of the plurality of first passages and the second passage on the interior side of the scroll compression part are provided in the first end plate or the second end plate.

5. The scroll compressor according to claim 2, wherein in a case where a boundary line on an inner peripheral side of the first trajectory is drawn by the outer arc of the first wall body of the fixed scroll in the compression chamber, an opening on the compression chamber side of one of the plurality of first passages, which is open to the compression chamber describing the first trajectory, is provided on a wall surface on a radially outward side of the first wall body of the fixed scroll or in the first end plate of the fixed scroll in the vicinity of the wall surface, and in a case where a boundary line on an outer peripheral side of the second trajectory is drawn by the inner arc of the first wall body of the fixed scroll in the compression chamber, an opening on the compression chamber side of another one of the plurality of first passages, which is open to the compression chamber describing the second trajectory, is provided on a wall surface on a radially inward side of the first wall body of the fixed scroll or in the first end plate of the fixed scroll in the vicinity of the wall surface.

6. The scroll compressor according to claim 5, wherein an end plate protrusion region, which is a region protruding toward the opposing end plate, in the surface of the first or second end plate on a side where the first or second wall body is provided to be erected, and a step portion extending along a boundary of the end plate protrusion region are provided on the first or second end plate of the fixed scroll or the orbiting scroll, and an opening of the second passage on the interior side of the scroll compression part is provided in the vicinity of the step portion and outside the end plate protrusion region.

7. The scroll compressor according to claim 2, wherein in a case where a boundary line on an inner peripheral side of the first trajectory is drawn by the outer arc of the first wall body of the fixed scroll in the compression chamber, an opening on the compression chamber side of the second passage, which is open to the compression chamber describing the first trajectory, is provided on a wall surface on a radially inward side of the second wall body of the orbiting scroll or in the second end plate of the orbiting scroll in the vicinity of the wall surface, and in a case where a boundary line on an outer peripheral side of the second trajectory is drawn by the inner arc of the first wall body of the fixed scroll in the compression chamber, an opening on the compression chamber side of the second passage, which is open to the compression chamber describing the second trajectory, is provided on a wall surface on a radially outward side of the second wall body of the orbiting scroll or in the second end plate of the orbiting scroll in the vicinity of the wall surface.

8. The scroll compressor according to claim 7, wherein an end plate protrusion region, which is a region protruding toward the opposing end plate, in the surface of the first or second end plate on a side where the first or second wall body is provided to be erected, and a step portion extending along a boundary of the end plate protrusion region are provided on the first or second end plate of the fixed scroll or the orbiting scroll, and an opening of the second passage on the interior side of the scroll compression part is provided in the vicinity of the step portion and outside the end plate protrusion region.

9. The scroll compressor according to claim 2, wherein openings of at least one first passage of the plurality of first passages and the second passage on the interior side of the scroll compression part are provided at positions where both the at least one first passage of the plurality of first passages and the second passage can simultaneously communicate with one compression chamber of the compression chambers by a movement of the compression chamber by the operation of the scroll compression part.

10. The scroll compressor according to claim 9, wherein an end plate protrusion region, which is a region protruding toward the opposing end plate, in the surface of the first or second end plate on a side where the first or second wall body is provided to be erected, and a step portion extending along a boundary of the end plate protrusion region are provided on the first or second end plate of the fixed scroll or the orbiting scroll, and an opening of the second passage on the interior side of the scroll compression part is provided in the vicinity of the step portion and outside the end plate protrusion region.

* * * * *